US007441767B2

(12) United States Patent
Saito

(10) Patent No.: US 7,441,767 B2
(45) Date of Patent: Oct. 28, 2008

(54) SHEET FEEDER WITH STACKING MEMBER LIFTED BY PLANETARY GEAR SYSTEM

(75) Inventor: Takashi Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 79 days.

(21) Appl. No.: 11/054,518

(22) Filed: Feb. 9, 2005

(65) Prior Publication Data

US 2005/0179194 A1 Aug. 18, 2005

(30) Foreign Application Priority Data

Feb. 13, 2004 (JP) ..... 2004-037258

(51) Int. Cl.
*B65H 1/08* (2006.01)

(52) U.S. Cl. ..... 271/147; 271/145; 271/162; 271/152; 271/154; 271/155; 271/127

(58) Field of Classification Search ..... 271/145, 271/162, 147, 152, 154, 155, 160, 127
See application file for complete search history.

(56) References Cited

U.S. PATENT DOCUMENTS 4,346,878 A * 8/1982 Aizawa ..... 271/118
5,008,715 A * 4/1991 Imaizumi et al. ..... 399/392
5,026,041 A * 6/1991 Kitazume et al. ..... 271/118
5,078,380 A * 1/1992 Kitazawa ..... 271/9.05
5,201,873 A * 4/1993 Kikuchi et al. ..... 271/9.13
5,213,426 A * 5/1993 Ewing ..... 400/624
5,219,155 A * 6/1993 Kanome ..... 271/114
5,853,171 A * 12/1998 Halpenny ..... 271/126
5,909,872 A * 6/1999 Takahashi ..... 271/116
5,954,327 A * 9/1999 Lin et al. ..... 271/110
6,056,285 A * 5/2000 Kikuta et al. ..... 271/118
6,059,282 A * 5/2000 Jang ..... 271/160
6,422,773 B1 * 7/2002 Lim ..... 400/710
6,443,445 B1 * 9/2002 Bortolotti ..... 271/117
6,778,262 B2 * 8/2004 Kaburagi et al. ..... 355/405
6,783,126 B2 * 8/2004 Amamoto ..... 271/152
6,994,341 B2 * 2/2006 Aoki et al. ..... 271/117
2003/0116906 A1 * 6/2003 Amamoto ..... 271/126

FOREIGN PATENT DOCUMENTS

JP 06-92480 A 4/1994

* cited by examiner

*Primary Examiner*—Patrick Mackey
*Assistant Examiner*—Gerald W McClain
(74) *Attorney, Agent, or Firm*—Panitch Schwarse Belisario & Nadel LLP

(57) ABSTRACT

To reduce the number of components and further to provide a downsized sheet feeder, a shaft is arranged to a lower side of a sheet receiver stacking sheets, and gears are respectively attached to each opposite end of the shaft to mesh with rack portions. The gears move, upon gear's rotating, up and down along the rack portions. Another gear in mesh with the gear is further formed to transmit a torque from a driving source to the gear.

6 Claims, 7 Drawing Sheets

SHEET FEEDER WITH STACKING MEMBER LIFTED BY PLANETARY GEAR SYSTEM

BACKGROUND OF THE INVENTION

1. Field of the Invention

This invention relates to a sheet feeder for storing sheets on a sheet cassette to feed the sheets and to a recording apparatus having the sheet feeder.

2. Description of Related Art

A recording apparatus such as, e.g., a printer, a photocopier, or the like conventionally has been formed with a sheet feeder for feeding sheets, at which a sheet cassette for storing the sheets is formed. On the sheet feeder, sheets are fed sheet by sheet from the topmost portion of the stored sheets, with a feeding means such as, e.g., a feeding roller or the like. The sheet feeder of this type, therefore, needs to lift the sheets upward.

Although as the apparatus of this type, an apparatus has been disclosed in, such as e.g., Japanese Patent Application Publication No. JA-H6-92480, the apparatus as described in the above publication has a mechanism in which a lift plate for lifting up a cassette plate stacked with sheets is fastened to a lift shaft with a screw or screws, and in which the lift plate is rotated upon transmittance of torque to a lift gear fastened to the lift shaft to lift up the sheets stacked on the cassette plate.

With the conventional sheet feeder described above, however, the lift plate is fastened to the lift shaft with the screw or screws to render the lift plate rotate to lift up the sheets stacked on the cassette plate, and the lift gear fastened to the lift shaft is needed, so that there may raise a problem that the number of components increases and that such apparatuses tends to be larger in size.

SUMMARY OF THE INVENTION

To solve above problems, a sheet feeder according to this invention is detachably attached in an inserting manner to a recording apparatus, and comprises: a stacking member for stacking a recording medium in a manner movable up and down; a lifting member for moving said stacking member up and down; a gear rotating as receiving driving force from said recording apparatus; and a planet gear moving along a circumference of said gear in accordance with rotation of and in mesh with said gear, wherein said lifting member moves up and down in accordance with movement of said planet gear.

According to this invention thus structured, no lift plate is needed, and what is required is to form a gear and a planet gear at each side portion of a stacking member and to form a lifting member at a lower portion of the stacking member, so that the number of components becomes reduced to render the apparatus downsized.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Figure 1:
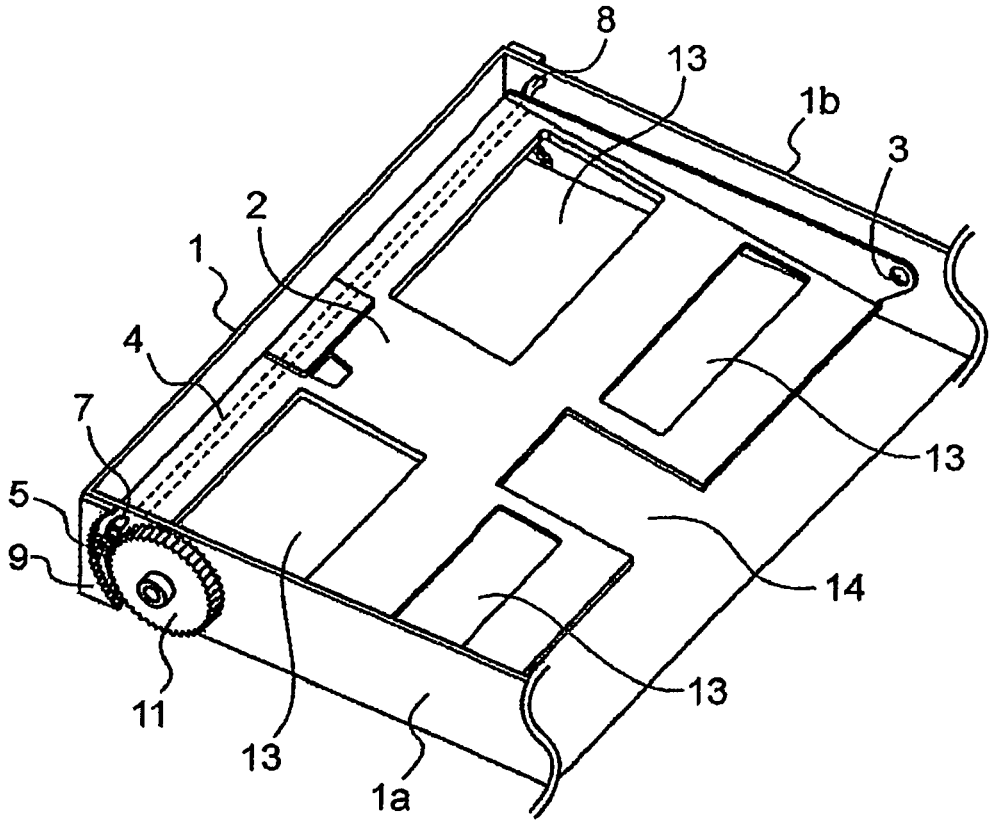
FIG. 1 is a perspective view showing a sheet feeder according to the first embodiment.
Figure 2:
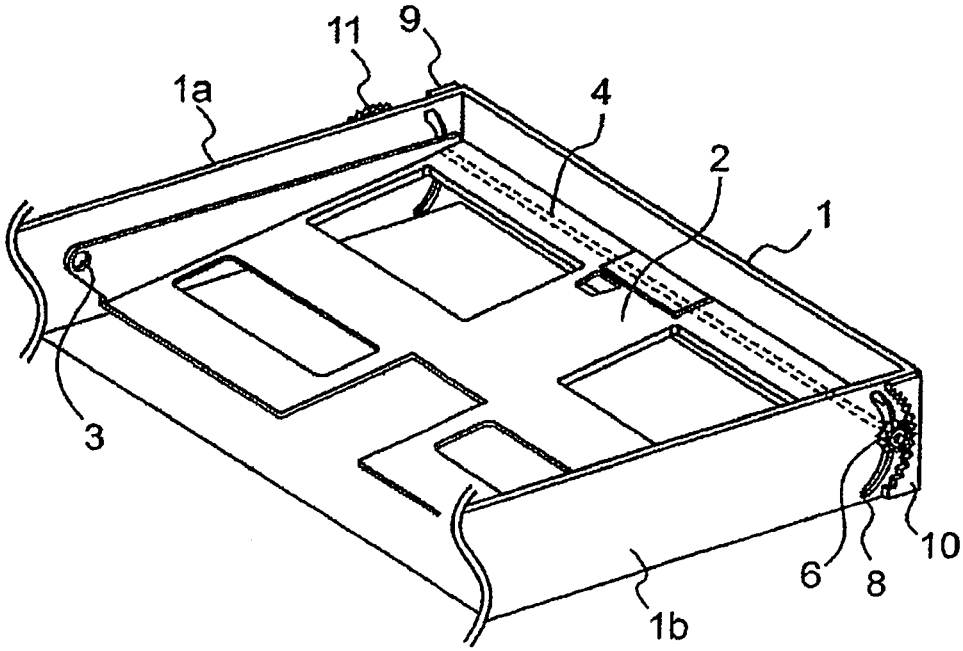
FIG. 2 is a perspective view showing the sheet feeder according to the first embodiment.
Figure 3:
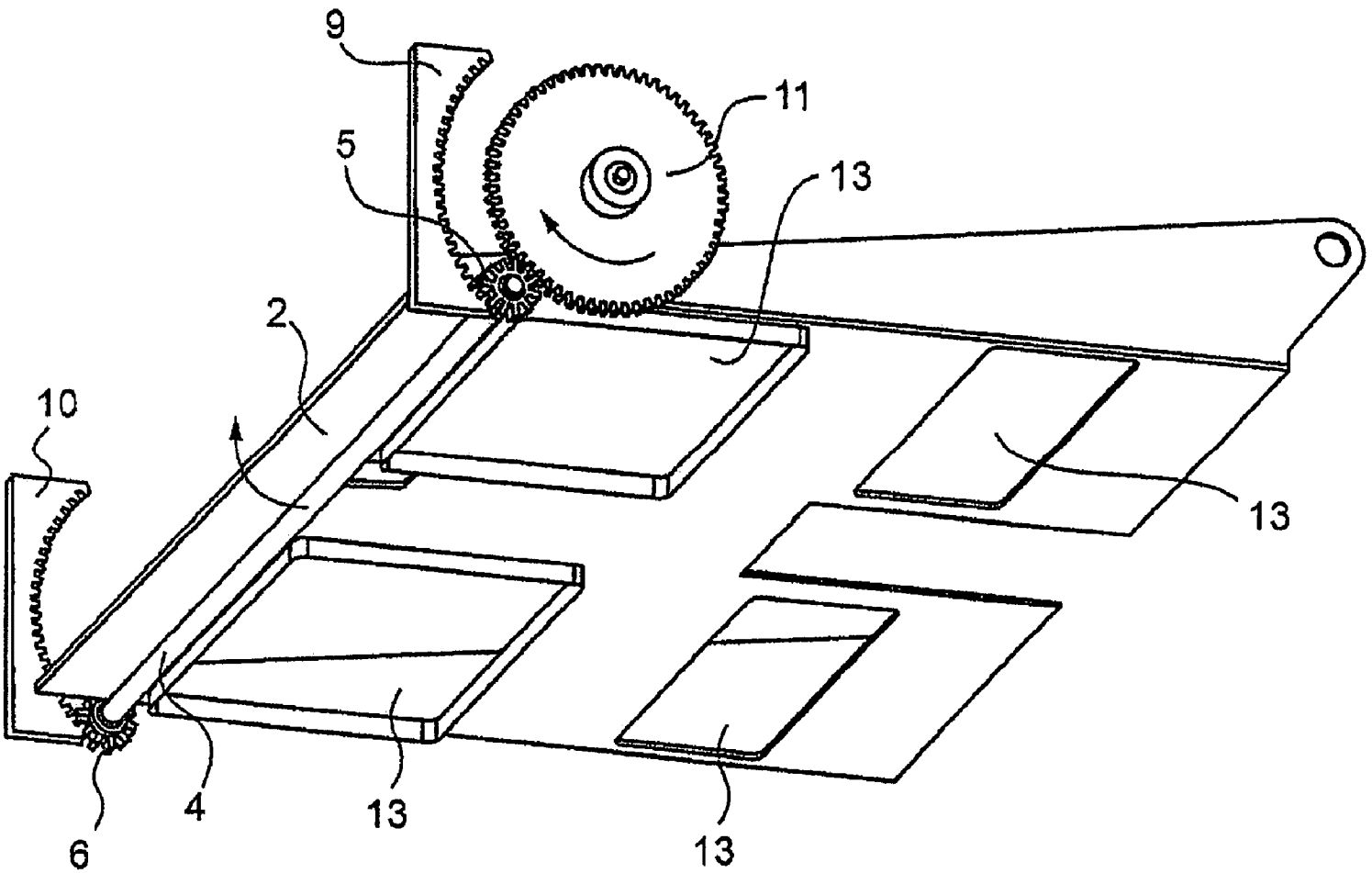
FIG. 3 is a perspective view showing substantial parts of the sheet feeder according to the first embodiment.

Hereinafter, embodiments according to this invention will be described. FIG. 1 and FIG. 2 are perspective views showing a sheet feeder according to the first embodiment of this invention, and FIG. 3 is a perspective view showing essential parts of the sheet feeder according to the first embodiment.

In those drawings, a sheet receiver 2 is disposed in a pivotal manner around a pivotal center 3 as a center on a sheet cassette 1 of the sheet feeder according to the first embodiment. Sheets (recording media) are to be stacked on the sheet receiver 2. A shaft 4 is arranged below a front end side of the sheet receiver 2. The shaft 4 is longer than the width of the sheet receiver 2, while gears 5, 6 are fixed respectively to opposite ends of the sheet receiver 2. Crescent shaped holes 7, 8 are respectively formed in side walls 1*a*, 1*b* of the sheet cassette 1, while each opposite end of the shaft 4 is respectively protruding from the crescent shaped holes 7, 8, respectively and secured respectively to the gears 5, 6 outside the side walls 1*a*, 1*b*. On a bottom portion of the sheet receiver 2, positioning holes 13 as well as a positioning grooves 14 are formed, to which a positioning member (described hereafter) engages for positioning the sheets in various sizes to be stored.

Rack portions 9, 10 are respectively attached to each end of the side walls 1*a*,1*b*. The rack portions 9, 10 respectively have teeth in mesh with the gears 5, 6, and the gears 5, 6 move up or down as rotating respectively in meshing with the rack portions 9, 10. A gear 11 for transmitting drive force to the gear 5 upon reception of the driving force from a driving source described below is rotatably attached to the side wall 1*a*, one of the walls. The gear 5 serves as a planet gear for moving around the gear 11 according to the rotation of the gear 11.

Figure 4:
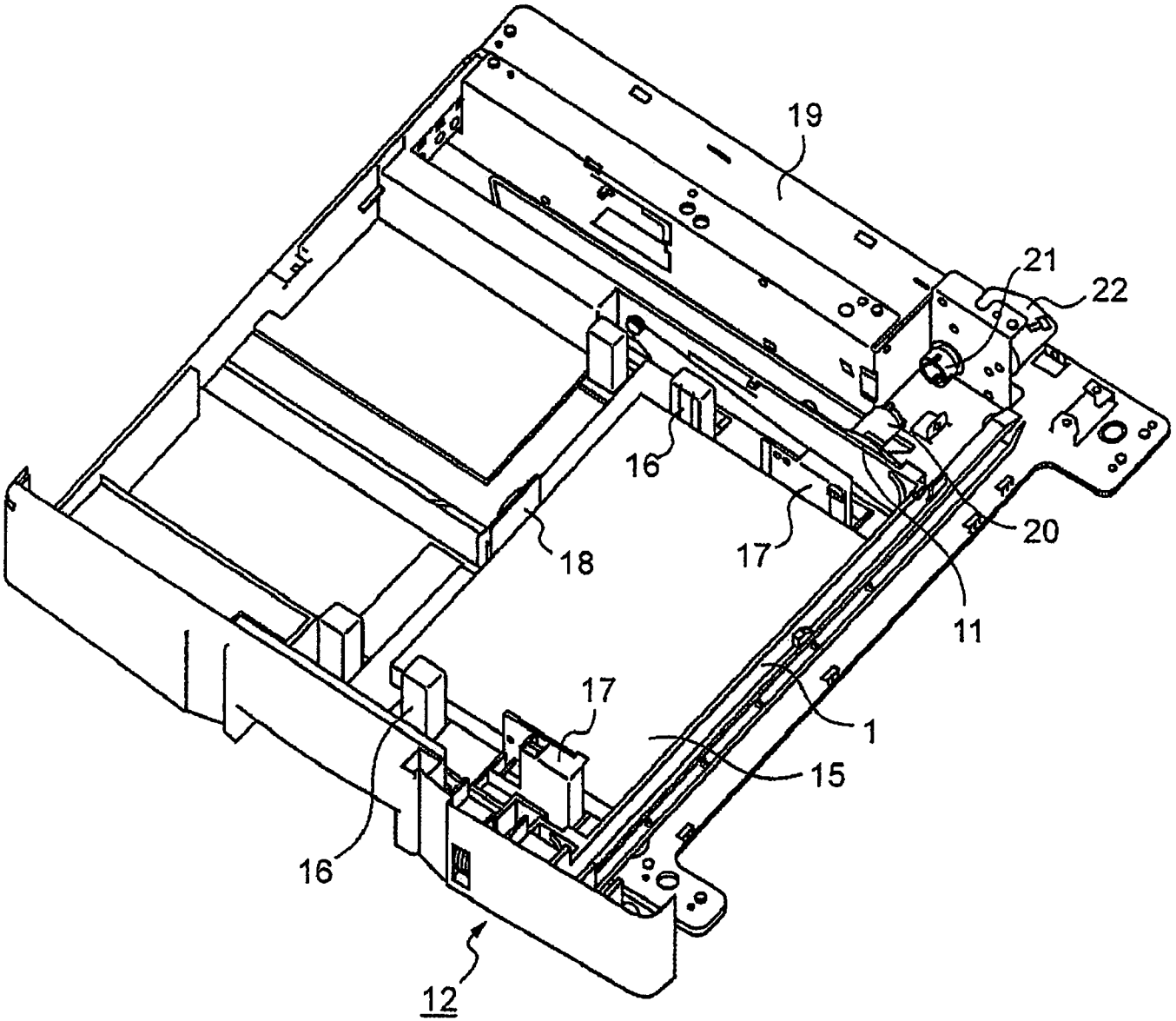
FIG. 4 is a perspective view showing the sheet feeder according to the first embodiment.
Figure 5:
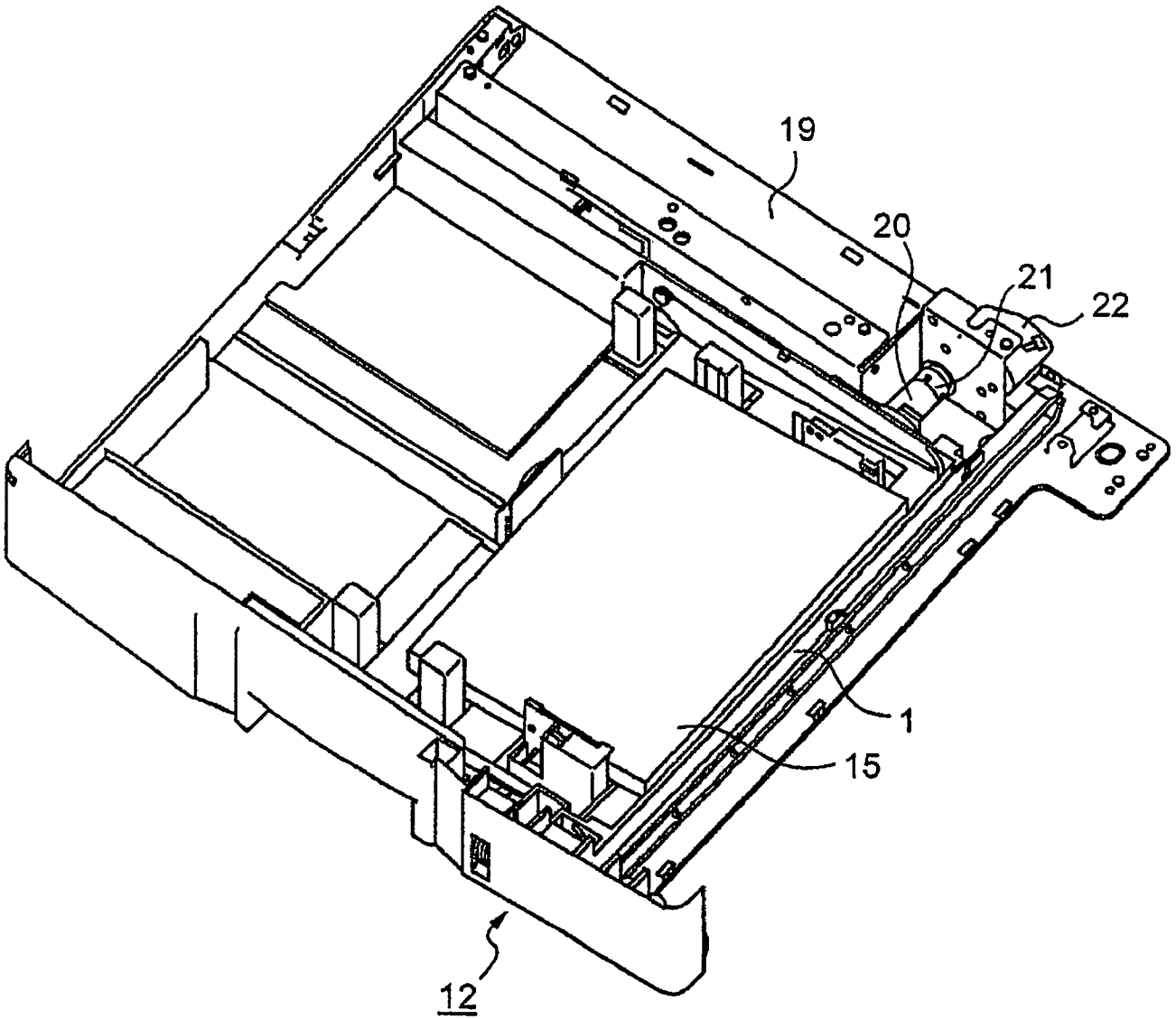
FIG. 5 is a perspective view showing the sheet feeder according to the first embodiment.

FIG. 4 and FIG. 5 are perspective views showing the sheet feeder according to the first embodiment. In FIG. 4 and FIG. 5, the sheet cassette 1 is attached to a sheet feeder 12, and sheets 15 (recording media) are stacked on the sheet receiver 2. The sheets 15 is positioned with side positioning members 16 and 17 with respect to a width direction, whereas positioned with a back positioning member 18 with respect to a rear side.

FIG. 4 shows a state at a time that the sheet feeder 12 is attached to an electrophotographic recording apparatus 19 serving as a recording apparatus, and in this bout, a joint portion 20 formed as united with the gear 11 formed to the sheet cassette 1 couples with a joint portion 21 formed on a side of the electrophotographic recording apparatus 19. A motor 22 rotates the joint portion 21.

FIG. 5 shows a state that the sheet feeder 12 has been attached to the electrophotographic recording apparatus 19, and in this bout, the joint portion 20 on a side of at the sheet feeder 12 couples with the joint portion 21 on the side of the electrophotographic recording apparatus 19.

Figure 6:
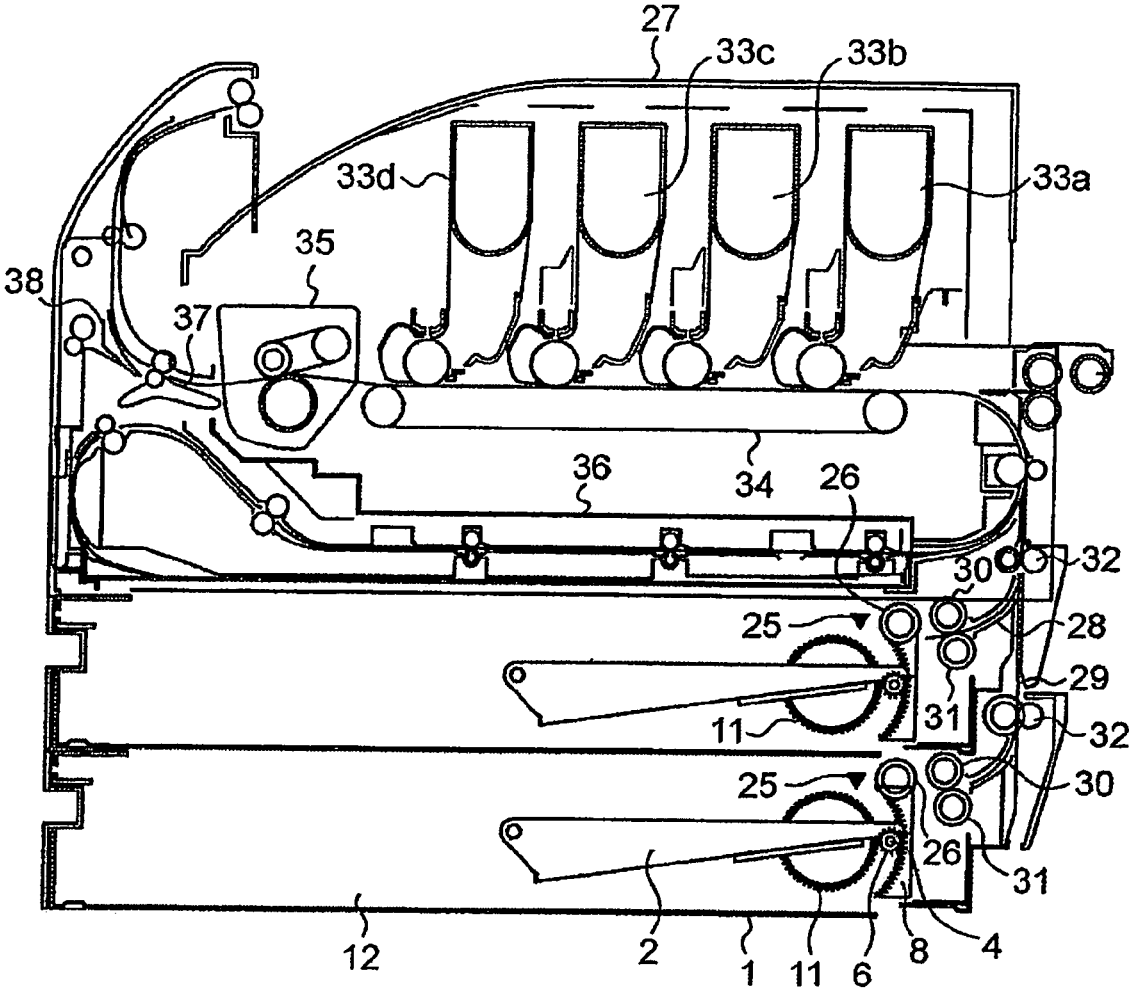
FIG. 6 is a schematic side view showing an electrophotographic recording apparatus installed with a sheet feeder.

FIG. 6 is a schematic side view showing the electrophotographic recording apparatus installed with the sheet feeder. In FIG. 6, two sheet feeders 12 in a tiered manner are attached, but both are structured in substantially the same way. In FIG. 6, a detection sensor 25 for detecting a level of the sheets is arranged above the front end of the sheet receiver 2 of the sheet feeder 12. Furthermore, a pick-up roller 26 is arranged above the front end of the sheet receiver 2, so that the sheets on the sheet receiver 2 are picked up sheet by sheet from the topmost of the sheets.

An electrophotographic recording section 27 is formed on an upper portion of the sheet feeder 12, and sheet conveyance routes 28, 29 are formed between the sheet feeder 12 and the electrophotographic recording section 27. A feed roller 30 and a reverse roller 31 are formed at the sheet conveyance routes 28, 29, and furthermore, a conveyance route roller 32 is arranged at the routes.

Four image forming portions, 33*a*, 33*b*, 33*c*, and 33*d*, a conveyance belt 34, a fusing device 35, and a double side recording conveyance route 36 are formed to the electrophotographic recording section 27, so multicolored recording can be implemented to single side or double sides of the sheets. Furthermore, blades 37, 38 for switching the sheet conveyance direction are formed on a downstream side of the fusing device 35.

In operation of the first embodiment, first, the sheets 15 are stacked on the sheet receiver 2 inside the sheet cassette 1, and then the sheet receiver 2 is attached as shown in FIG. 4 to the electrophotographic recording apparatus 19. As shown in FIG. 5, this attachment results the joint portion 20 of the sheet feeder 12 to couple with the joint portion 21 of the electrophotographic recording apparatus 19. The rotational force of the motor 22 therefore becomes transmittable to the gear 11.

When the motor 22 is driven, the gear 11 rotates in a direction of an arrow as shown in FIG. 3, so the gear 5 rotates in a direction opposite to the gear 11. The rotation of the gear 5 is transmitted through the shaft 4 to the gear 6 at the opposite side, so the gears 5, 6 move up in mesh with the rack portions 9, 10 according to that rotation. The shaft 4 also moves up accordingly to lift the sheet receiver 2 up.

Where the sheet receiver 2 is pushed up, the sheets 15 stacked thereon are also lifted up, so the topmost sheet 15 is detected with the detection sensor 25. Based on the detection with the detection sensor 25, a controller, not shown, of the electrophotographic recording apparatus stops the motor 22, thereby causing the upward movement of the sheets 15 to be stopped. This stop position is at that the pick-up roller 26 can pick up the topmost sheet.

When the printing instruction is transmitted to the controller of the electrophotographic recording apparatus, the pick-up roller 26 is rendered to rotate to pick up the topmost sheet 15 and feeds the sheet on the sheet conveyance route 28 or 29. The picked sheet 15 is conveyed in the sheet conveyance route 28 or 29 with the conveyance route roller 32, thereby being transmitted to the electrophotographic recording section 27.

In the electrophotographic recording section 27, the conveyance belt 34 conveys the sheet 15 while four image forming portions 33*a*, 33*b*, 33*c*, and 33*d* transfer toner images based onto printing data to the sheet 15. The toner images transferred onto the sheet 15 are fused with the fusing device 35, and then the blade 37 switches the conveyance direction so as to send the sheet to the double side recording conveyance route 36 to form the images in a case where the back side is thereafter to be printed as well or switches the conveyance direction so the sheet 15 is fed to the delivery portion to be delivered in a case of one side printing.

Where the printing is further made, the pick-up roller 26 picks up the sheet 15 to implement the printing operation in substantially the same way as above. When the number of the sheets 15 is reduced as the printing operation goes further, the detection sensor 25 comes not to detect the sheets 15. The motor 22 is thereby driven with the controller, not shown, of the electrophotographic recording apparatus to rotate the gear 11, so the sheet receiver 2 is pushed up again according to the above described operation. This operation is then repeated.

When the sheet feeder 12 is detached from the electrophotographic recording apparatus 9, the joint portion 20 of the sheet feeder 12 is separated from the joint portion 21 of the electrophotographic recording apparatus 9. Holding force on the gear 11 as well as the gears 5, 6 is then released, and the gears 5, 6 move downward as meshing with the racks 9, 10 because of the self-weight of the sheet receiver 2, and consequently, the sheet receiver 2 moves downward. Because of this downward movement, the sheets 15 are separated from the pick-up roller 26 even where the topmost sheet 15 is in contact with the pick-up roller 26.

According to the first embodiment as described above, since the sheet receiver 2 is rendered to move up and down with the gears 5, 6, the rack portions 9, 10, the gear 11, and the shaft 4, it is unnecessary, unlike the conventional arts, to form a lift plate, so the apparatus can be downsized. Furthermore, loads exerted to the gears 5, 6, the rack portions 9, 10, and the gear 11 can be reduced, and as the result, the level of the sheets 15 can be precisely positioned.

The amount of sheets stored on one sheet cassette increases recently, thereby resulting the load exerted to the sheet receiver to increase as well. According to the first embodiment, the rotation of the gear 11 is firstly transmitted to the gear 5, and the gear 5 tends to rush up the rack portion 9, but the rotation of the gear 5 is, at the same time, transmitted through the shaft 4 to the gear 6 at the opposite side. At that time, if the sheet receiver 2 bears the great load, the shaft 4 may be twisted, so that there is possibility that the gears 5, 6 do not rotate at the same time. In that case, the gears 5, 6 move upward in a state of having a time lag, so a problem may occur such that the sheet receiver 2 does not move up horizontally.

Figure 7:
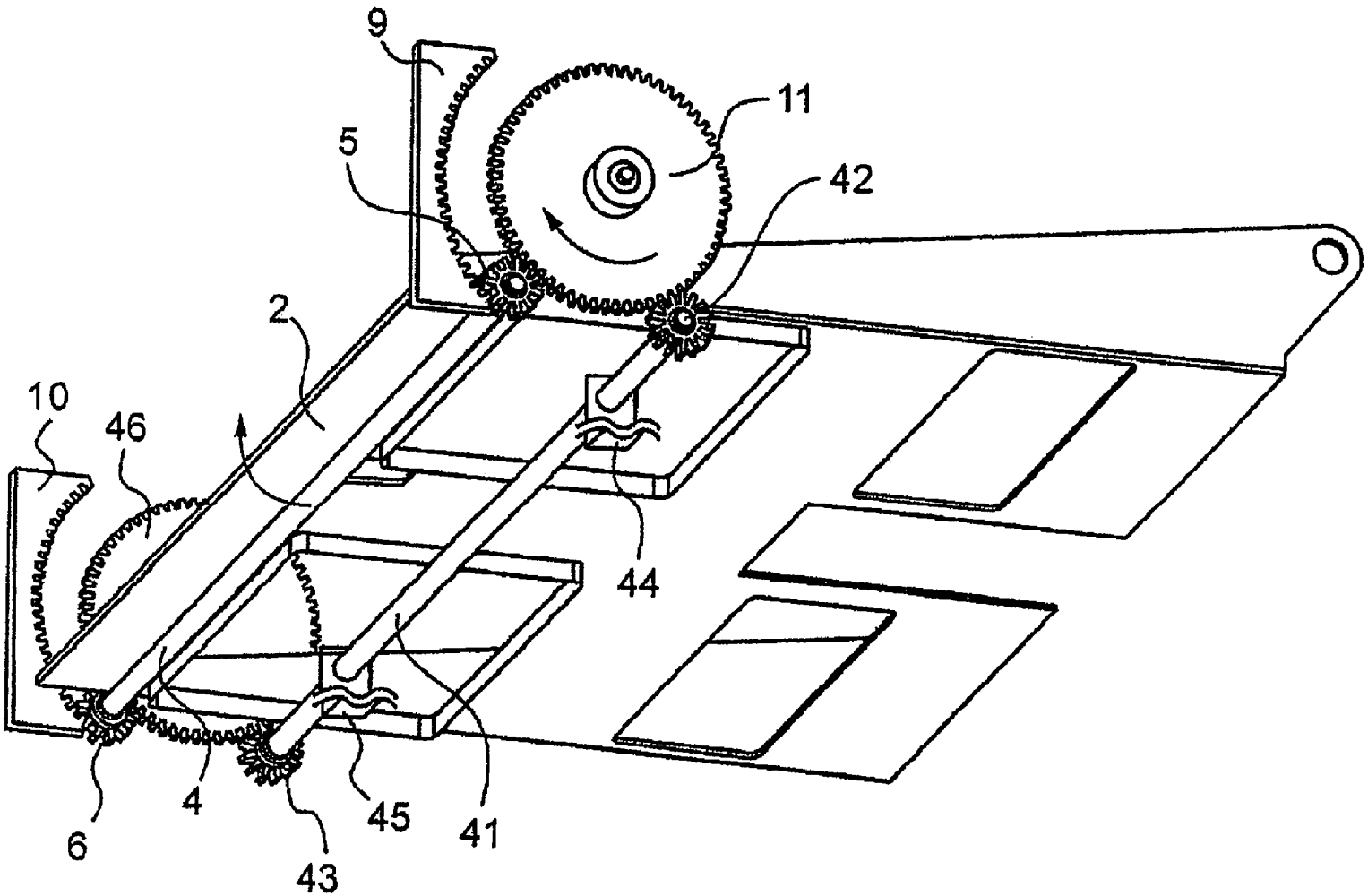
FIG. 7 is a perspective view showing substantial parts of a sheet feeder according to the second embodiment.

The second embodiment is accomplished in consideration of viewpoints such as above. FIG. 7 is a perspective view showing essential parts of a sheet feeder according to the second embodiment. In FIG. 7, a shaft 41 is formed below the sheet receiver 2, in which gears 42, 43 are respectively secured to each opposite end of the shaft 41. The shaft 41 is rotatably attached to the sheet feeder body with bearing portions 44 and 45. The gear 42 is in mesh with the gear 11, while the gear 43 at the opposite side is in mesh with an idle gear 46. The idle gear 46 is formed rotatably to the sheet feeder body. The other structures are substantially the same as the first embodiment.

Operation of the second embodiment is described next with applying the drawings used in the first embodiment. As described above, the rotational force of the motor 22 on the side of the electrophotographic recording apparatus 19 is transmittable to the gear 11 upon attachment of the sheet feeder 12 storing the sheets to the electrophotographic recording apparatus 19.

When the motor 22 is driven, the gear 11 rotates in a direction of an arrow as shown in FIG. 7. The gear 5, therefore, rotates in the opposite direction to the gear 11, and the gear 42 rotates as well. The rotation of the gear 42 is transmitted through the shaft 41 to the gear 43 on the opposite side, and further transmitted through the idle gear 46 to the gear 6.

On the other hand, the rotation of the gear 5 is transmitted through the shaft 4 to the gear 6 at the opposite side. That is, the rotation is transmitted to the gear 6 through two routes, so the gears 5, 6 can rotate in the same phase.

The gears 5, 6 move, upon rotating, upward respectively as in mesh with the racks 9, 10. The shaft 4 therefore moves upward to push the sheet receiver 2 upward.

When the sheet receiver 2 is lifted up, the sheets 15 stacked thereon are also lifted up, so the topmost sheet 15 is detected with the detection sensor 25. Based on the detection with the detection sensor 25, a controller, not shown, of the electrophotographic recording apparatus stops the motor 22, thereby causing the upward movement of the sheets 15 stopped. This stop position is at which the pick-up roller 26 can pick up the topmost of the sheets. The subsequent printing operations and the operation for detaching the sheet feeder are substantially the same as those of the first embodiment.

As described above, according to the second embodiment, in addition to having substantially the same advantages as the first embodiment, the sheet receiver 2 can move up in a horizontal state even where the sheet receiver 2 bears a great load due to increase of the sheet stacking amount, since the rotation of the gear 11 is transmitted to the gear 6 on the opposite side by means of the gear 42, the shaft 41, the gear 43, and the idle gear 46 though the route other than the route via the shaft 4. Because sheet receiver 2 moves up in the horizontal state, occurrence of skew or the like can be prevented when the sheets are picked up.

Figure 8:
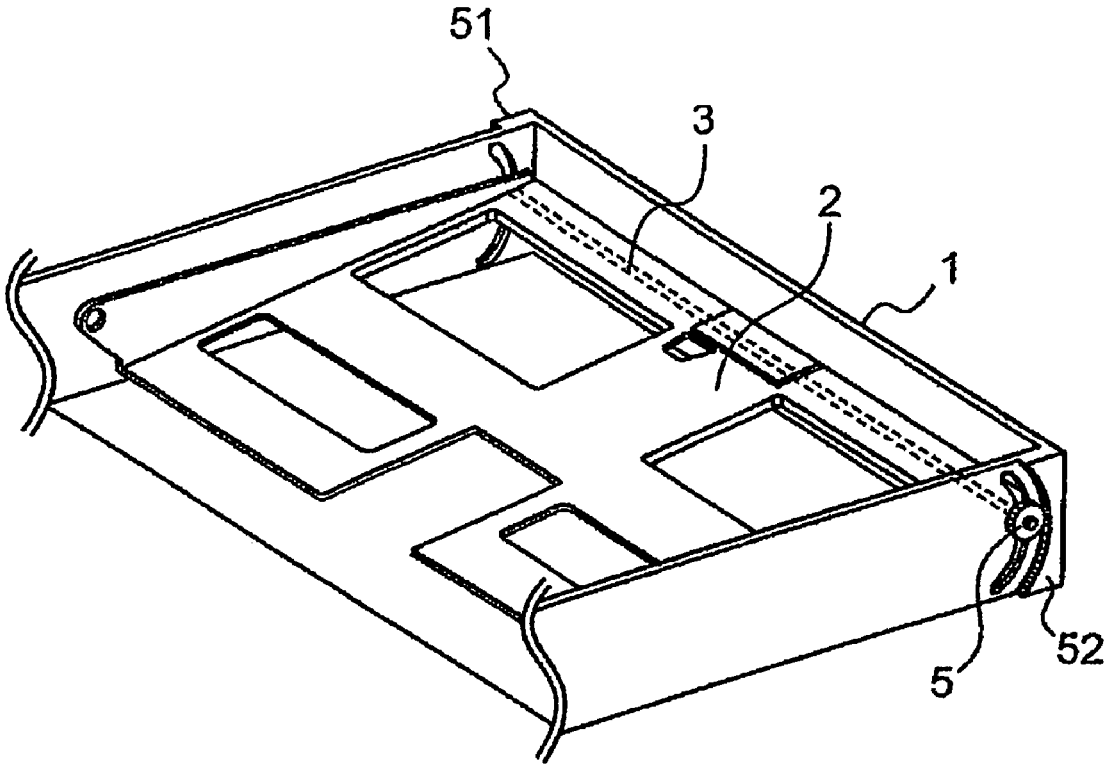
FIG. 8 is a perspective view showing a modification example.

This invention is not limited to above described embodiments, but can be variously modified. For example, as shown in FIG. 8, the rack portions 51, 52 formed to the sheet cassette 1 may be formed as united with side walls 1*a*, 1*b* of the sheet cassette 1. By forming the rack portions 51, 52 as a united body, the number of components can be reduced, so the cost of the apparatus can be lowered.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A sheet feeder detachably attached in an inserting manner to a recording apparatus, comprising:

a stacking member for stacking sheets of a recording medium, the stacking member being movable up and down;

a rotating drive gear receiving a driving force from said recording apparatus, said drive gear transmitting said driving force to move said stacking member up and down;

a lifting member for moving said stacking member up and down;

a first curved rack portion on a first sidewall of the sheet feeder, said first rack portion having a curvature matching a circumference of said drive gear; and a first planet gear moving along the circumference of said drive gear in accordance with rotation of and in mesh with said drive gear, said first planet gear being sandwiched between said drive gear and said first rack portion and being engaged with said drive gear and said first rack portion, wherein said lifting member moves up and down in accordance with movement of said planet gear.

2. The sheet feeder according to claim 1, further comprising:

a second curved rack portion arranged on a second sidewall opposite to the first sidewall on which the first rack portion is arranged;

a second planet gear engaged with the second rack portion, wherein the first planet gear and the second planet gear are connected by the lifting member, and wherein the drive gear transmits the driving force from the recording apparatus to the first planet gear.

3. The sheet feeder according to claim 2, and further comprising a driving force transmission member held rotatably between third and fourth planet gears and receiving the driving force in mesh with said drive gear.

4. The sheet feeder according to claim 1, and further comprising a detector for detecting a level of sheets stacked on said stacking member, and wherein the driving force is controlled based the detected level of the sheets.

5. A recording apparatus having the sheet feeder according to claim 1.

6. A recording apparatus having the sheet feeder according to claim 4.

* * * * *